US007526222B2

(12) United States Patent
Fukuda

(10) Patent No.: US 7,526,222 B2
(45) Date of Patent: Apr. 28, 2009

(54) IMAGE PRINTING APPARATUS AND PAYMENT METHOD

(75) Inventor: Hiroshi Fukuda, Asaka (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 10/995,094

(22) Filed: Nov. 24, 2004

(65) Prior Publication Data

US 2005/0117931 A1 Jun. 2, 2005

(30) Foreign Application Priority Data

Nov. 28, 2003 (JP) ..... 2003-399389

(51) Int. Cl.
*G03G 21/02* (2006.01)
*G03G 15/00* (2006.01)

(52) U.S. Cl. ..... 399/79; 399/80; 399/81

(58) Field of Classification Search ..... 399/79, 399/80, 81
See application file for complete search history.

(56) References Cited

U.S. PATENT DOCUMENTS 6,574,443 B1 * 6/2003 Butikofer et al. ..... 399/79
6,890,690 B2 * 5/2005 Wexler et al. ..... 430/11
2003/0004834 A1 * 1/2003 Yamazaki ..... 705/26
2004/0081300 A1 * 4/2004 Takae et al. ..... 379/114.01
2004/0133525 A1 * 7/2004 Singh et al. ..... 705/77
2004/0249733 A1 * 12/2004 Clough et al. ..... 705/34

FOREIGN PATENT DOCUMENTS

JP 11-224285 A 8/1999
JP 2000-268095 A 9/2000
JP 2001-77953 A 3/2001
JP 2001-243383 A 9/2001
JP 2002-32279 A 1/2002

* cited by examiner

*Primary Examiner*—Timothy J Dole
*Assistant Examiner*—Amy He
(74) *Attorney, Agent, or Firm*—Sughrue Mion, PLLC

(57) ABSTRACT

The image printing apparatus according to the present invention includes a communications device which communicates data with a service server for providing a chargeable service over a network, a print device which prints an image on a predetermined print medium, a request input device through which a user input a request, a request execution device which uses a chargeable service by communicating data with the service server through the communications device in accordance with a request input through the request input device, obtains an image to be printed, and prints the image on a predetermined print medium by the print device, and a payment device which performs a paying process on separate payees between a printing rate for the image and a use rate for the chargeable service in a charge on the user.

26 Claims, 3 Drawing Sheets

IMAGE PRINTING APPARATUS AND PAYMENT METHOD

BACKGROUND OF THE INVENTION

1. Field of the Invention

The present invention relates to an image printing apparatus, and more specifically to an image printing apparatus capable of using various service over a network, and a payment method for the use rate of each service.

2. Description of the Related Art

An image printing apparatus which allows a user to operate and print an image of a user taken by the user using a digital camera and a mobile telephone with a camera, etc. is mounted in various places.

According to this type of image printing apparatus, a user inserts a recording medium storing images into a predetermined slot, selects an image, and input a coin for a predetermined amount depending on the number of image to be printed, a high-precision image printed paper (what is called a "photo print") can be easily obtained. Since it is necessary to realize an easy operation, a printing rate per image is equally set. Therefore, since a total amount of charge for printing is proportional to the number of prints, the manager who has provided the image printing apparatus can easily manage the apparatus by simply checking the number of printed images and the related sales amount.

On the other hand, as an information terminal apparatus which is operated by a user, communicates with a predetermined server over a network, authenticates access authorization, inputs a rate, and prints an image received from a server has become popular these days (Japanese Patent Application Publication No. 2001-243383).

In the Internet connection service, by issuing at least two or more IDs to a user in a contract, Internet connection can be realized using a course optionally selected by a user from among a plurality of courses which charges different rates (Japanese Patent Application Publication No. 2002-32279).

SUMMARY OF THE INVENTION

However, when various types of printout services are offered on the image printing apparatus of conventional self-print type, it is necessary to differentiate the printing rate depending on the service contents. Furthermore, an additional rate on top of the printing rate can be charged.

For example, not only printing an image taken by the user, but also services such as printing a dedicated image for a registered member, distributing a coupon and a ticket specific to a registered member, and providing map information, etc. are requested. By the realization of various services, the image printing apparatus mounted in various places are to be efficiently used. However, not only the printing rate system is complicated, but also the rate of a chargeable image, the rate of a ticket, and the rate of map information are to be correctly charged to the user to correctly manage the sales, thereby complicating the sales management and making the management difficult.

The present invention has been developed to solve the above-mentioned problems. An object of the present invention is to provide an image printing apparatus and method capable of offering various services to a self-operating user and easily performing the sales management.

To attain the above-described object, the first aspect of the present invention comprises: a communications device which communicates data with a service server for providing a chargeable service over a network; a print device which prints an image on a predetermined print medium; a request input device through which a user input a request; a request execution device which uses a chargeable service by communicating data with the service server through the communications device in accordance with a request input through the request input device, obtains an image to be printed, and prints the image on a predetermined print medium by the print device; and a payment device which performs a paying process on separate payees between a printing rate for the image and a use rate for the chargeable service in a charge on the user.

With the configuration, various services can be provided for a self-operating user, and a paying process can be performed on each payee in paying an image printing rate and a chargeable service use rate, thereby allowing a manager of the image printing apparatus to perform an easy operation such as sales management, etc.

The second aspect of the present invention according to the first aspect further comprises a card interface which reads necessary information in paying a charge using a card, wherein the payment device performs a paying process according to the information read from the card through the card interface.

In this case, the component for supporting the payment in cash (notes, coin) can be excluded from the apparatus.

In the present invention, the card includes a credit card, a cash card, a membership card, a prepaid card, etc.

With the configuration, since the user can make a payment by a card. Therefore, it is not only convenient for a user, but the manager of the image printing apparatus can easily collect the rate and easily manage the operation.

In the third aspect of the present invention according to the first or second aspect, the request execution device prints a chargeable image provided by the service server or a superimposed image obtained by superimposing the chargeable image with a user image using the print device; and the payment device performs a paying process on separate payees between a rate for a chargeable image and a printing rate in a charge on the user.

With the configuration, a service of printing a chargeable image such as a landscape picture, a picture of a famous person, a created design, a scene in the movies, a noted character in animation, etc., a service of superimposing one of the chargeable images with a user image and printing it can be provided without complicating the operation of the manager of the image printing apparatus. The user can not only enjoy printing various images, but can effectively use the self-operated image printing apparatus, thereby effectively utilizing the use self-operated image printing apparatus.

In the fourth aspect of the present invention according to the third aspect, an image of the user is an image obtained from a user terminal over a network, an image recorded on a user terminal and obtained from a predetermined recording medium, or an image obtained through immediate communications with the user terminal.

In the present invention, the user terminal may be a mobile telephone with a camera, a PDA (Personal Digital Assistant) with a camera, etc.

In the fifth aspect of the present invention, the chargeable service includes, for example, distribution of an image, distribution of a ticket, or map information.

In the sixth aspect of the present invention according to any of the first to the fifth aspects, the payment device performs a paying process in cooperation with a payment proxy server connected to a network, and the payment proxy server designates a manager of a service server which provides the chargeable service, and pays a use rate of the chargeable service in a charge on a user to a manager of a service server which provides the chargeable service.

With the configuration, even when a plurality of service servers are available, a manager of a service server is designated by a payment proxy server, and a use rate of a chargeable service is extracted from the entire charge of the user and paid to the manager of the corresponding service server. Therefore, the manager of the image printing apparatus is free of work load, and the distribution management is left to the manager of the payment proxy server, thereby allowing the manager of the image printing apparatus to easily manage the operation.

In the seventh aspect of the present invention, a chargeable service use request is received from a user, the chargeable service is used by communicating data with a service server which provides a chargeable service in accordance with the use request over a network, a print request for an image is received from a user, an image is printed on a predetermined print medium in accordance with the print request, and a paying process is performed on separate payees between a printing rate of the image and a use rate of the chargeable service in a charge on the user.

According to the present invention, various services can be provided for a self-operating user, and an operation such as sales management of the manager of the image printing apparatus can be easily performed although there are use rates including a printing rate and a chargeable service in a mixed manner.

DETAILED DESCRIPTION OF THE PREFERRED EMBODIMENTS

The best mode for embodying the image printing apparatus and the payment method according to the present invention is described below by referring to the accompanying drawings.

Figure 1:
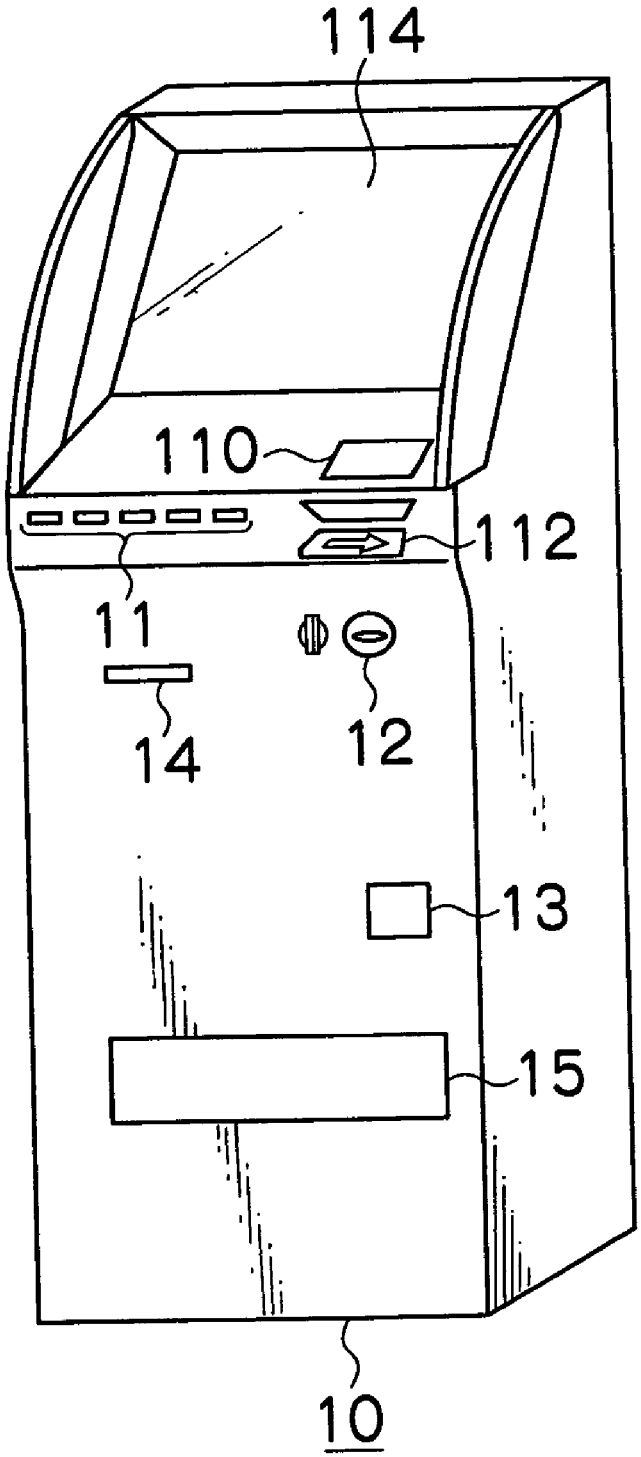
FIG. 1 is a perspective view of the appearance of the image printing apparatus according to an embodiment of the present invention.
Figure 2:
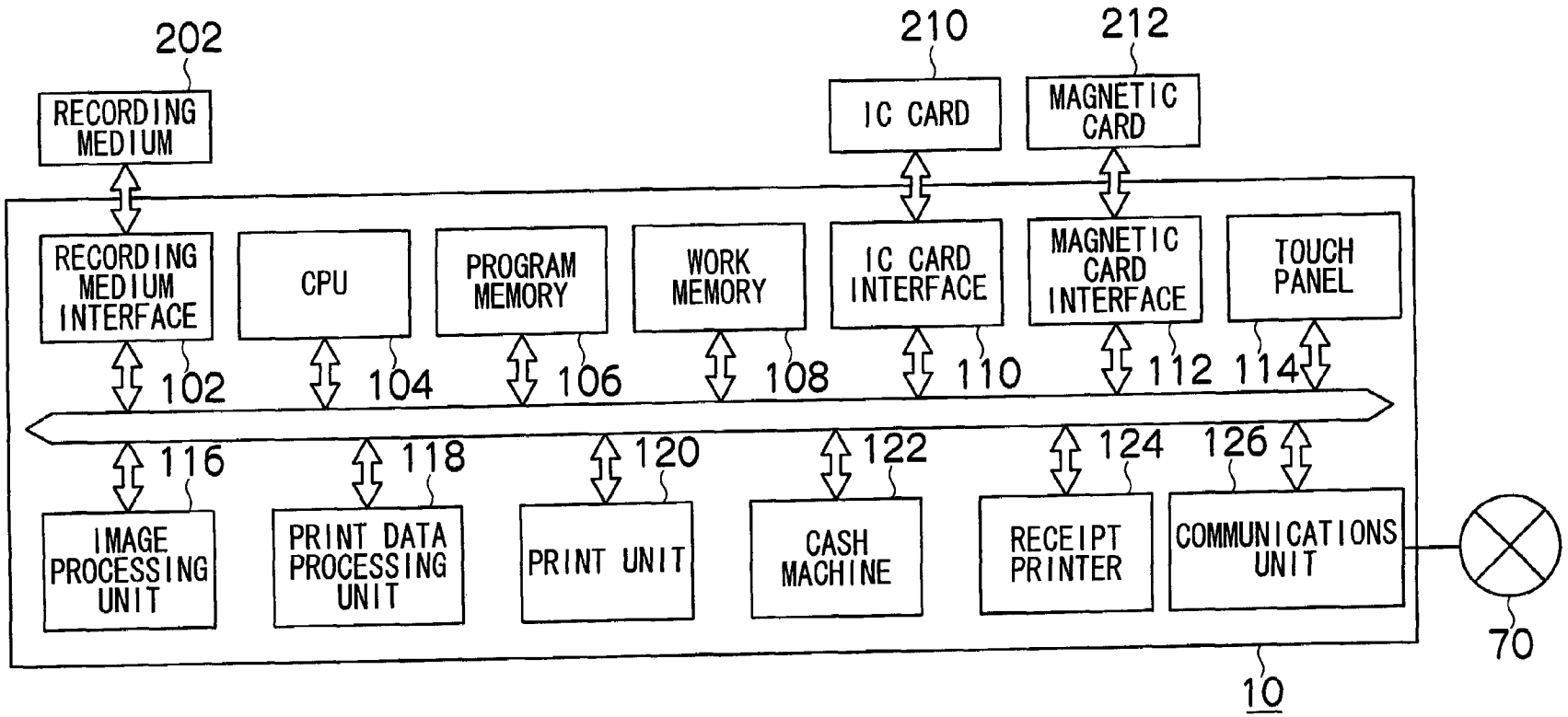
FIG. 2 is a block diagram of the internal configuration of the image printing apparatus according to an embodiment of the present invention.

FIG. 1 is a perspective view of the appearance of an image printing apparatus 10 according to an embodiment of the present invention. FIG. 2 is a block diagram of the internal configuration of the image printing apparatus 10 according to an embodiment of the present invention.

In FIG. 1, the image printing apparatus 10 is provided with a touch panel 114 which allows a user to operate the image printing apparatus 10 and print an image on the image printing apparatus 10. A recording medium slot 11 is a unit into which a recording medium recording an image using a digital camera, a mobile telephone with a camera, etc. is inserted. An IC card interface 110 reads and writes information from and to a user IC card. A magnetic card interface 112 reads and writes information from and to a user magnetic card. A coin slot 12 is a unit into which a user inserts coin, and a coin refund outlet 13 is a unit through which coin is returned to the user. A note slot 14 is a unit into which a user inserts a note, and also a unit from which s bank is returned to the user. A print outlet 15 is a unit from which an image-printed paper (what is called a "print") is ejected.

In FIG. 2, a recording medium interface 102 obtains an image of a user from the recording medium 202. A CPU (central processing unit) 104 integrally controls each unit of the image printing apparatus 10. Program memory 106 is configured by, for example, ROM (read only memory), and stores a program, etc. Work memory 108 is configured, for example, RAM (random access memory), and is used in each process such as an image superimposing process, etc. The IC card interface 110 reads and writes information from and to a user IC card 210. The magnetic card interface 112 reads and writes information from and to a user magnetic card 212. The touch panel 114 displays various information to a user, and receives a request from a user. An image processing unit 116 performs an image expanding process, etc. A print data processing unit 118 converts an image processed by the image processing unit 116 into a data format for printing. A print unit 120 prints an image on a predetermined print medium. A cash machine 122 performs a paying process for the coin inserted into the coin slot 12 and the note inserted into the note slot 14. A receipt printer 124 prints a receipt. A communications unit 126 communicates with each apparatus connected to a network 70.

The CPU 104 uses a chargeable service by communicating with a service server described later and connected to the network 70 through the communications unit 126 in accordance with a request input through the touch panel 114, obtains an image to be printed, and prints the image on the print unit 120 in a predetermined print medium. The CPU 104 cooperates with a payment proxy server described later and connected to the network 70 through the communications unit 126, and performs a paying process on each payee of an image printing rate and a chargeable service use rate extracted from a charge of a user.

When a user presents on the touch panel 114 a superimposed print of a user image with a chargeable image, the CPU 104 superimposes a chargeable image provided by a service server described later with a user image, and prints a superimposed image on the print unit 120.

There are various styles of obtaining a user image. According to an embodiment of the present invention, first the image is obtained from a mobile telephone with a camera through the communications unit 126 over the network 70, and the image is also obtained from the recording medium 202 by the recording medium interface 102. Otherwise, the image can be obtained directly by a short-distance wireless communications with a mobile telephone. In this case, it is necessary to provide a device which performs a short-distance wireless communications with a mobile telephone.

The IC card interface 110 and the magnetic card interface 112 support various cards, for example, a credit card, a cash card, a membership card, and a prepaid card.

In the present embodiment, the request input device is configured by the touch panel 114, the request execution device is configured mainly by the CPU 104, and the payment device is configured mainly by the CPU 104.

Figure 3:
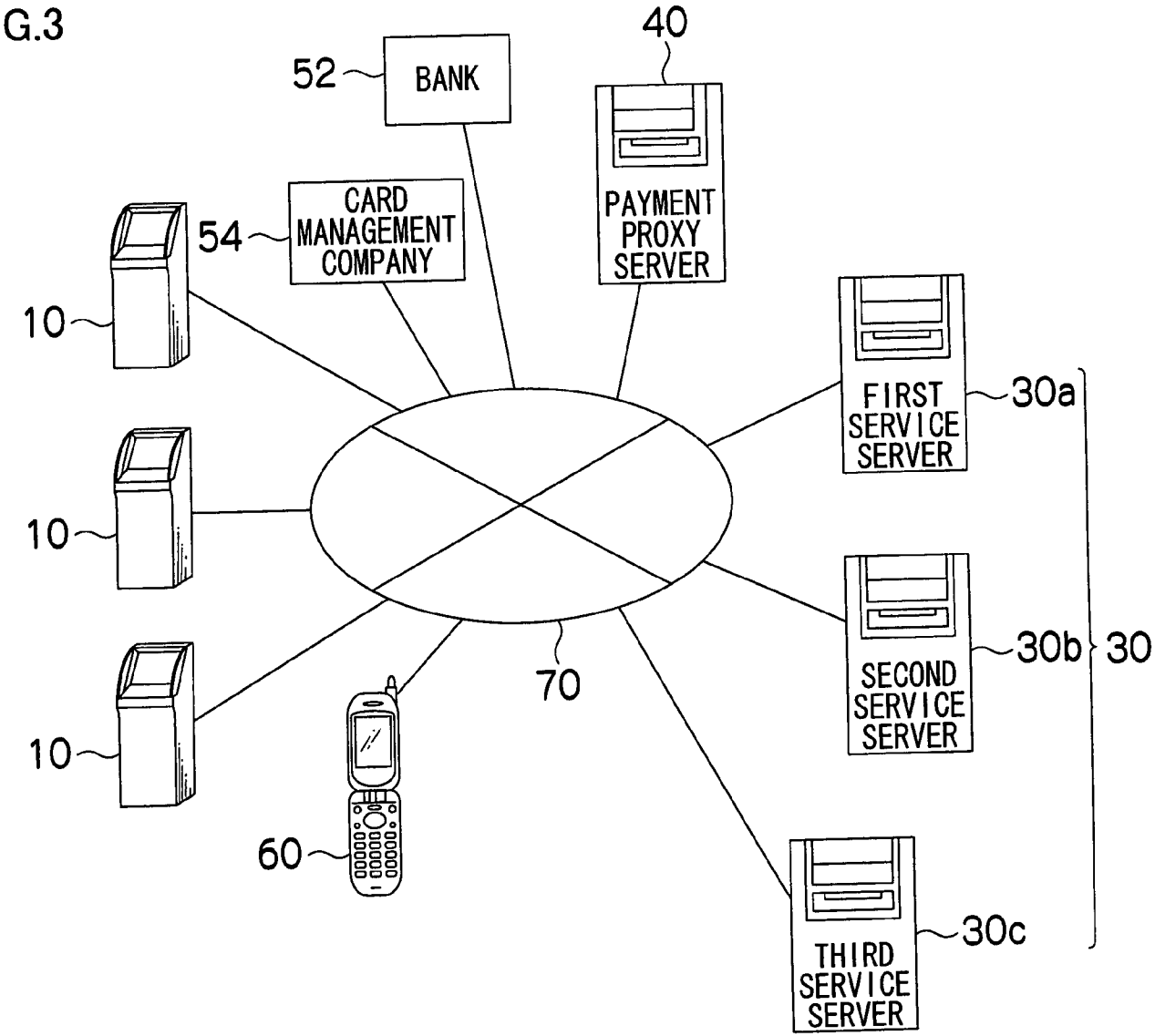
FIG. 3 shows the entire configuration of the system including the image printing apparatus according to an embodiment of the present invention.

FIG. 3 shows the entire configuration of the system including the image printing apparatus 10 according to the present embodiment.

In FIG. 3, the image printing apparatus 10, a service server 30 (30*a*, 30*b*, and 30*c*), a payment proxy server 40, a bank 52, a card management company 54, and a mobile telephone 60 are connected to the network 70.

The first service server 30*a* distributes a chargeable image to the image printing apparatus 10.

The second service server 30*b* distributes chargeable map information to the image printing apparatus 10.

The third service server 30*c* distributes a ticket to the image printing apparatus 10, that is, distributes ticket information about coupons, tickets for admission of various events, etc. The image printing apparatus 10 prints an actual ticket according to the distributed ticket information. Instead of printing a ticket, ticket information can be directly transferred to the mobile telephone 60 by performing short-distance wireless communication with the mobile telephone 60. In this case, it is necessary to provide the image printing apparatus 10 with a device which performs short-distance wireless communications with the mobile telephone 60. The third service server 30*c* also receives a reservation of a ticket for admission of various events, etc.

The payment proxy server 40 designates a manager of the service server 30 which provides a chargeable service, and performs a paying process on the manager of the service server 30 which offered the chargeable service by extracting the use rate of the chargeable service from the entire charge of the user, and also performs a process of paying a printing rate to a manager of the image printing apparatus 10 by extracting the rate from the entire charge of the user.

The user can receive various services by operating the image printing apparatus 10 by himself or herself. There are various use styles, but the typical four styles are described below.

First, a user image taken by the mobile telephone 60 with a camera, etc. can be printed. For example, when the user extracts a recording medium 202 storing images from the mobile telephone 60 with a camera, and inserts it into the recording medium slot 11 of the image printing apparatus 10, the recording medium interface 102 of the image printing apparatus 10 reads the image from the recording medium 202, a list of images is displayed on the touch panel 114 of the image printing apparatus 10. When the user selects a desired image and performs an operation of printing an image according to the list, the user-selected image is printed. Electronic mail with an image from the mobile telephone 60 is transmitted to a predetermined mail address, and the image printing apparatus 10 obtains an image over the network 70 and can print the image. If there is no charge to the user in addition to a printing rate, only the printing rate is charged to the user.

Second, a desired image can be downloaded from the service server 30, and can be printed. Practically, the network 70 includes the first service server 30*a* which provides an image such as a landscape picture, a picture of a famous person, a created design, a scene in the movies, a noted character in animation, etc. and the second service server 30*b* which provides map information. When the user downloads an image on the image printing apparatus 10 and requests printing the image, the image downloaded from the first service server 30*a* and the second service server 30*b* is printed. It is also possible to purchase coupons, tickets for admission of various events, etc. from the third service server 30*c* and print them. In this case, if the service server 30 provides a chargeable service, the use rate of the service server 30 in addition to the printing rate are charged to the user.

Third, the user image taken by the mobile telephone 60 with a camera, etc. and the image provided by the service server 30 can be superimposed and printed. Practically, the image read by the recording medium 202 or the image transmitted by electronic mail from the mobile telephone 60 is superimposed with an image provided by the first service server 30*a* such as a landscape picture, a picture of a famous person, a created design, a scene in the movies, a picture of a noted character in animation, etc., and printed on the image printing apparatus 10. The image superimposing is performed by the CPU 104 of the image printing apparatus 10 by superimposing, for example, a chargeable image downloaded from the first service server 30*a*. The first service server 30*a* can superimpose the user image with the chargeable image, and the superimposed image can be downloaded from the first service server 30*a* to the image printing apparatus 10.

Fourth, a service provided by the service server 30 can be used for a purpose other than printing an image. For example, various information provided by the first service server 30*a* and the second service server 30*b* can be browsed, and making a reservation of ticket of various events through the third service server 30*c* can be performed. In this case, only the use rate of the service server 30 can be charged to the user, or the apparatus use rate can be further charged to the user.

When an image is printed using a chargeable service of the service server 30 in the use styles described above, a printing rate and a use rate of the service server 30 are included in the charge for the user in a mixed manner. Furthermore, although one of the printing rate and the use rate of the service server 30 is to be charged to a user in each use style, both the printing rate and the use rate of the service server 30 are to be charged to the user if they are continuously used in a plurality of use styles.

The cases in which both the printing rate and the use rate of the service server 30 are charged to the user are summarized as follows. When a request to use a chargeable service is received from a user by the touch panel 114, communications are established with the service server 30 which offers a chargeable service in accordance with the use request through the communications unit 126 over the network 70, and the chargeable service can be used. When an image print request is received from a user by the touch panel 114, the image is printed in a predetermined print medium in accordance with the print request. About the charge to the user, the printing rate for an image and the use rate of the chargeable service are separately paid depending on the payees.

A paying process is basically performed under the control of the CPU 104 of the image printing apparatus 10. Particularly the total rate and the details are displayed on the touch panel 114, and notified to the user of the information. The user can pay by cash using a note and coin, or by a IC card 210 and a magnetic card 212. The coin is inserted into the coin slot 12, and the note is inserted into the note slot 14, and a change is ejected through the coin refund outlet 13 or the note slot 14. The IC card 210 is read by the IC card interface 110, and the magnetic card 212 is read by the magnetic card interface 112, and a payment is made according to the read information.

There are actually various operation styles of the IC card 210 and the magnetic card 212. Typical examples are a credit card, a cash card, (a debit card, etc.), a prepaid card, a membership card, etc. A credit card is used in making a payment in cooperation with the card management company 54. A cash card is used in making a payment in cooperation with the bank 52. When a prepaid card has, for example, records of points corresponding to the amount, the point can be subtracted and a prepaid amount is distributed. There are a number of membership cards. For example, if the point corresponding to the amount is assigned to a user and recorded on a membership card, the point can be subtracted, and the fund of the membership cards is distributed. Otherwise, what is called electronic money is used in making a payment existing in a mobile telephone by communication with a mobile telephone, for example.

In a payment process, it is not necessary to perform the processes relating to the calculation of accounting for a user and the distribution of the account only in the CPU 104 of the image printing apparatus 10. In the present embodiment, it is performed in cooperation with the payment proxy server 40 for performing a payment process over the network 70. Thus, the complicated processes relating to the payment proxy operations to be performed when various chargeable services of the service server 30 are available by a user can be left to the payment proxy server 40. Moreover, a manager having the image printing apparatus 10 can manage a small photograph shop without no person having sufficient knowledge about payment. FIG. 3 describes only one payment proxy server 40, but there can be a plurality of payment proxy servers 40 for a distributing process to improve the reliability and efficiency.

The payment proxy server 40 cooperates with the bank 52 and the card management company 54 to pay a printing rate to the manager of the image printing apparatus 10, and pay a use rate of a chargeable service to the manager of the service server 30. Thus, the payment proxy server 40 can also manage the payment of a printing rate. It is also possible to multiply a use rate of a chargeable service by a predetermined rate to charge the product to a user as the payment proxy operation of charge, and set the payment proxy operation free of charge. The payment proxy server 40 can be managed by a specific organization different from the manager of the 30, or a manager of a specific service server (for example, the first service server 30*a*) can also manage the payment to another service server (30*b*, 30*c*).

As a practical example, the case in which a user transmits a user image attached to electronic mail to a specific mail address from the mobile telephone 60, downloads a chargeable image from the first service server 30*a*, and prints a superimposed image of the user image and the chargeable image on the image printing apparatus 10 is described below.

A user adds a plurality of images taken by the mobile telephone 60 with a camera to electronic mail and transmits them to a specific mail address, for example, the mail address of the first service server 30*a*. Upon receipt of the electronic mail, the first service server 30*a* issues a reception number and an ID code and transmits return mail to the user of the mobile telephone 60.

A user who receives return mail operates the touch panel 114 of the image printing apparatus 10, and inputs the reception number and the ID code notified by return mail.

Based on the reception number, the image printing apparatus 10 communicates with the first service server 30*a* associated with the reception number, and performs an authenticating process by the reception number and the ID code. Then the authentication is completed, a plurality of user images corresponding to the reception number are transmitted from the first service server 30*a* to the image printing apparatus 10. On the touch panel 114 of the image printing apparatus 10, a plurality of user images are displayed as a list. The user operates the touch panel 114 of the image printing apparatus 10 to select a desired image.

The image printing apparatus 10 further communicates with the first service server 30*a*, obtains a chargeable image which can be superimposed with the user image from the first service server 30*a*, and displays the chargeable image on the touch panel 114. The image printing apparatus 10 obtains also the information about the use rate of a chargeable image and the payment method, etc. together with the chargeable image from the first service server 30*a*, and when the user confirms the chargeable image, it displays the information on the touch panel 114. The printing rate is also displayed on the touch panel 114.

When the user requests printing a superimposed image between a chargeable image and a user image displayed on the touch panel 114, the image printing apparatus 10 requests the user to perform a paying operation. The user uses a card (IC card or magnetic card) to perform a paying operation. The image printing apparatus 10 requests the user to input a password as necessary. When a prepaid card is used, a point corresponding to the rate can be subtracted from the prepaid card.

When a paying operation is performed using a card, the CPU 104 of the image printing apparatus 10 transmits the information read from the card to the payment proxy server 40 through the communication unit 126. The payment proxy server 40 manages it to make withdrawal from the bank 52 or notification to the card management company 54. The information read from the card contains user identification information, and then is given to the payment proxy server 40 for determination as to which user the charge is issued. The CPU 104 of the image printing apparatus 10 communicates with the payment proxy server 40 through the communications unit 126, cooperates with the payment proxy server 40 to calculates a service rate and a printing rate based on the identification information about the service server 30 (first service server 30*a* in this case) which is a provider of the service used by the user, the service condition of the service server 30, the identification information about the image printing apparatus 10, and the printing condition of the image printing apparatus 10 including the number of prints, the print size, and the print type. Moreover, the CPU 104 performs a distributing process of distributing the charge to the corresponding user to a printing rate for the manager of the corresponding image printing apparatus 10 and a service use rate for the manager of the corresponding first service server 30*a*. A use rate of a chargeable service to be paid to the manager of the first service server 30*a* can be, in addition to the use rate of a chargeable image, a user-specified service such as a storage service of a user present invention, etc. in the first service server 30*a*. The rate to be paid to the manager of the 10 can be a use rate of the apparatus when it is used without printing an image. When a payment proxy commission is collected, the collecting process is performed. The payee of the service use rate, etc. paying a rate to the manager of the service server 30, for example, the account number of the bank, is associated with the identification information of the service server 30, and registered in advance in the database (omitted in the accompanying drawings) of the payment proxy server 40 for each service server 30. The payee of a printing rate, etc., for example, the account number of a bank in paying a rate to a manager of the image printing apparatus 10 is associated with the identification information about the image printing apparatus 10, and registered in advance in the database (omitted in the attached drawings) of the payment proxy server 40 for each image printing apparatus 10. The payment proxy server 40 performs a paying process in cooperation with the bank 52 and the card management company 54 such that the account to a user can be correctly distributed to each manager of each service server 30 and to each manager of the image printing apparatus 10 based on the user identification information notified by the image printing apparatus 10, the identification information about the service server 30 and the identification information about the image printing apparatus 10.

The image printing apparatus 10 superimposes a user image with a chargeable image, prints the superimposed image on a paper, and ejects the printed paper to the print outlet 15. Simultaneously, the receipt printer 124 prints a receipt and ejects it to the print outlet 15. The receipt is printed containing the detailed breakdown for each of the printing rate for an image and the use rate of a chargeable service together with the total amount of charge.

The present invention can appropriately reduce or change the above-mentioned descriptions or embody the addition of the well-known technology without changing a gist of the present invention, and includes the embodiments within the gist of the present invention. For example, the service server 30 is not limited to distribute an image, a ticket, and provide map information, but can provide other services. Additionally, the image printing apparatus 10 can perform the entire process of the paying operation without cooperation with the payment proxy server 40. The present invention further includes the configuration of the payment proxy server 40 and the service server 30 incorporated into one unit.

What is claimed is:

1. An image printing apparatus, comprising:

a communications device which communicates data with a service server for providing a chargeable service over a network;

a print device which prints an image on a predetermined print medium;

a request input device through which a user input a request;

a request execution device which uses a chargeable service by communicating data with the service server through the communications device in accordance with a request input through the request input device, obtains an image to be printed, and prints the image on a predetermined print medium by the print device; and a payment device which performs a paying process on separate payees between a printing rate for the image and a use rate for the chargeable service in a charge on the user, wherein the printing rate is paid to a manager of a printing apparatus printing the image and the use rate of the chargeable service is paid to a manager of the service server, wherein the paying process does not require registration by the user.

2. The image printing apparatus according to claim 1, further comprising: a card interface which reads necessary information in paying a charge using a card, wherein the payment device performs a paying process according to the information read from the card through the card interface.

3. The image printing apparatus according to claim 2, wherein:

the request execution device prints a chargeable image provided by the service server or a superimposed image obtained by superimposing the chargeable image with a user image in the print device; and the payment device performs a paying process on separate payees between a rate for a chargeable image and a printing rate in a charge on the user.

4. The image printing apparatus according to claim 3, wherein an image of the user is an image obtained from a user terminal over a network, an image recorded on a user terminal and obtained from a predetermined recording medium, or an image obtained through immediate communications with the user terminal.

5. The image printing apparatus according to claim 4, wherein the user terminal is a mobile telephone with a camera.

6. The image printing apparatus according to claim 5, wherein the payment device performs a paying process in cooperation with a payment proxy server connected to a network, and the payment proxy server designates a manager of a service server which provides the chargeable service, and pays a use rate of the chargeable service in a charge on a user to a manager of a service server which provides the chargeable service.

7. The image printing apparatus according to claim 3, wherein the payment device performs a paying process in cooperation with a payment proxy server connected to a network, and the payment proxy server designates a manager of a service server which provides the chargeable service, and pays a use rate of the chargeable service in a charge on a user to a manager of a service server which provides the chargeable service.

8. The image printing apparatus according to claim 4, wherein the payment device performs a paying process in cooperation with a payment proxy server connected to a network, and the payment proxy server designates a manager of a service server which provides the chargeable service, and pays a use rate of the chargeable service in a charge on a user to a manager of a service server which provides the chargeable service.

9. The image printing apparatus according to claim 2, wherein the chargeable service includes distribution of an image, distribution of a ticket, or map information.

10. The image printing apparatus according to claim 9, wherein the payment device performs a paying process in cooperation with a payment proxy server connected to a network, and the payment proxy server designates a manager of a service server which provides the chargeable service, and pays a use rate of the chargeable service in a charge on a user to a manager of a service server which provides the chargeable service.

11. The image printing apparatus according to claim 2, wherein the payment device performs a paying process in cooperation with a payment proxy server connected to a network, and the payment proxy server designates a manager of a service server which provides the chargeable service, and pays a use rate of the chargeable service in a charge on a user to a manager of a service server which provides the chargeable service.

12. The image printing apparatus according to claim 1, wherein:

the request execution device prints a chargeable image provided by the service server or a superimposed image obtained by superimposing the chargeable image with a user image in the print device; and the payment device performs a paying process on separate payees between a rate for a chargeable image and a printing rate in a charge on the user.

13. The image printing apparatus according to claim 12, wherein an image of the user is an image obtained from a user terminal over a network, an image recorded on a user terminal and obtained from a predetermined recording medium, or an image obtained through immediate communications with the user terminal.

14. The image printing apparatus according to claim 13, wherein the user terminal is a mobile telephone with a camera.

15. The image printing apparatus according to claim 14, wherein the payment device performs a paying process in cooperation with a payment proxy server connected to a network, and the payment proxy server designates a manager of a service server which provides the chargeable service, and pays a use rate of the chargeable service in a charge on a user to a manager of a service server which provides the chargeable service.

16. The image printing apparatus according to claim 13, wherein the payment device performs a paying process in cooperation with a payment proxy server connected to a network, and the payment proxy server designates a manager of a service server which provides the chargeable service, and pays a use rate of the chargeable service in a charge on a user to a manager of a service server which provides the chargeable service.

17. The image printing apparatus according to claim 12, wherein the payment device performs a paying process in cooperation with a payment proxy server connected to a network, and the payment proxy server designates a manager of a service server which provides the chargeable service, and pays a use rate of the chargeable service in a charge on a user to a manager of a service server which provides the chargeable service.

18. The image printing apparatus according to claim 1, wherein the chargeable service includes distribution of an image, distribution of a ticket, or map information.

19. The image printing apparatus according to claim 18, wherein the payment device performs a paying process in cooperation with a payment proxy server connected to a network, and the payment proxy server designates a manager of a service server which provides the chargeable service, and pays a use rate of the chargeable service in a charge on a user to a manager of a service server which provides the chargeable service.

20. The image printing apparatus according to claim 18, wherein the use rate corresponds to at least one of the cost to use the distributed data, the cost of a ticket or the cost associated with the right to reproduce a map.

21. The image printing apparatus according to claim 1, wherein the payment device performs a paying process in cooperation with a payment proxy server connected to a network, and the payment proxy server designates a manager of a service server which provides the chargeable service, and pays a use rate of the chargeable service in a charge on a user to a manager of a service server which provides the chargeable service.

22. The image printing apparatus according to claim 1, wherein the payment device determines the charge for the user based on at least two separate payees, wherein the charge comprises the use rate for one payee and a printing rate for a payee different than the one payee.

23. The image printing apparatus according to claim 1, wherein the use rate corresponds to charges for obtaining the image to be printed.

24. A payment method, comprising:

receiving a chargeable service use request from a user;

using the chargeable service by communicating data with a service server which provides a chargeable service in accordance with the use request over a network;

receiving a print request for an image from a user;

printing an image in accordance with the print request on a predetermined print medium; and performing a paying process on separate payees between a printing rate of the image and a use rate of the chargeable service in a charge on the user, wherein the printing rate is paid to a manager of a printing apparatus printing the image and the use rate of the chargeable service is paid to a manager of the service server, wherein the paying process does not require registration by the user.

25. An image printing apparatus, comprising:

a communications device which communicates data with a service server for providing a chargeable service over a network;

a print device which prints an image on a predetermined print medium; a request input device through which a user input a request;

a request execution device which uses a chargeable service by communicating data with the service server through the communications device in accordance with a request input through the request input device, obtains an image to be printed, and prints the image on a predetermined print medium by the print device; and a payment device which performs a paying process on separate payees between a printing rate for the image and a use rate for the chargeable service in a charge on the user, wherein the printing rate is paid to a manager of a printing apparatus printing the image and the use rate of the chargeable service is paid to a manager of the service server, wherein the paying process is simultaneous with the printing of the image.

26. The image printing apparatus according to claim 25, wherein the paying process does not require registration by the user.

* * * * *